US007183914B2

(12) United States Patent
Norman et al.

(10) Patent No.: US 7,183,914 B2
(45) Date of Patent: Feb. 27, 2007

(54) HANG TAG WITH SWIVEL ATTACHMENT

(75) Inventors: Michael Norman, East Brunswick, NJ (US); Chet Kolton, Westfield, NJ (US); Robert Whittemore, Montgomery, NY (US)

(73) Assignee: B & G Plastics, Inc., Newark, NJ (US)

( * ) Notice: Subject to any disclaimer, the term of this patent is extended or adjusted under 35 U.S.C. 154(b) by 189 days.

(21) Appl. No.: 11/067,824

(22) Filed: Feb. 28, 2005

(65) Prior Publication Data

US 2006/0202833 A1 Sep. 14, 2006

(51) Int. Cl.
*G08B 13/18* (2006.01)
*G08B 13/14* (2006.01)

(52) U.S. Cl. ..... 340/568.1; 340/571; 340/572.1; 340/572.8; 40/662; 40/664; 40/665

(58) Field of Classification Search ..... 340/568.1, 340/568.4, 571, 572.1, 572.8; 235/435, 439; 40/299.01, 662, 669, 665, 664; 24/17 B, 24/69 R See application file for complete search history.

(56) References Cited

U.S. PATENT DOCUMENTS

| | | | | |
|---|---|---|---|---|
| 5,070,581 | A | 12/1991 | Senter | 24/3 J |
| 5,515,580 | A | 5/1996 | McHenry, Jr. | 24/16 PB |
| 5,524,463 | A | 6/1996 | Schenkel et al. | 70/57.1 |
| 5,615,454 | A | 4/1997 | Contarino | 24/3.13 |
| 5,699,591 | A | 12/1997 | Kane | 24/304 |
| 6,188,320 | B1 * | 2/2001 | Kolton et al. | 340/572.9 |
| 6,380,855 | B1 | 4/2002 | Ott | 340/568.2 |
| 6,624,753 | B2 | 9/2003 | Elston | 340/572.8 |
| 2006/0145873 | A1 * | 7/2006 | Feibelman et al. | 340/572.9 |

* cited by examiner

*Primary Examiner*—Toan N. Pham
(74) *Attorney, Agent, or Firm*—Hoffman & Baron, LLP

(57) ABSTRACT

A hang tag provides for the accommodation of electronic article surveillance (EAS) marker. The hang tag includes a housing for supporting the EAS marker therein. A securement head is provided for accommodating a securement strap for coupling the housing to an article which is to be protected. The head is coupled to the housing in such a fashion that it permits continuous rotation with respect to the housing to thwart and attempt to improperly sever the securement strap from the article.

16 Claims, 4 Drawing Sheets

HANG TAG WITH SWIVEL ATTACHMENT

FIELD OF THE INVENTION

The present invention relates generally to a theft deterrent security tag for attachment to an article, and more particularly, relates to a hang tag for supporting an electronic article surveillance marker.

BACKGROUND OF THE INVENTION

The use of EAS markers to provide for theft protection of an article to which it is attached is well known. EAS articles may be placed on or attached to various articles which are susceptible to theft. An associated detection apparatus is placed at the exit of a facility to detect the unauthorized transit of the article through the exit. Labels, tags, hangers and various other products may incorporate EAS markers to deter the theft of the article.

With many of the EAS markers, by nature of the marker itself or by the article to which it attached, location of the marker on the article is readily apparent to the prospective purchaser. Since the purchaser is aware of the presence of the EAS mark, the purchaser may attempt to remove the EAS marker in an unauthorized manner in an attempt to defeat the electronic surveillance system.

One method of an attachment of an EAS marker to an article is by the use of a hang tag. Hang tags such as the one shown in U.S. Pat. No. 6,624,753 provide a housing for supporting the EAS marker. A strap or cable tie is attached to the housing and the strap may be inserted into or around the article to be protected and permanently attached again to the body. One technique to remove such a tag in an unauthorized manner is to twist the body of the hang tag by rotating the hang tag with respect to the strap. This causes tension on the strap which, upon sufficient application, will cause the strap to sever allowing the hang tag to be removed improperly from the article.

While it is desirable to use hang tags as they can be easily applied to a number of differently shaped articles, hang tags of this type suffer from this disadvantage.

It is, therefore, desirable to provide a hang tag which can support an EAS marker and which can be applied to an article where the hang tag cannot be easily and improperly severed from the article.

SUMMARY OF THE INVENTION

The present invention provides a hang tag for supporting an EAS marker therein. The hang tag includes a housing which supports the EAS marker and a securement head affixed thereto. The securement head accommodates a securement strap for coupling the housing to an article to be protected. The head is coupled to the housing in such a fashion that it permits continuous rotation with respect thereto to thwart an attempt to improperly sever the strap from the housing.

In one embodiment of the present invention, the head is separately formed from the strap and the strap may be placed in the head subsequently.

In another embodiment, the strap may be integrally formed with the head. In such an embodiment the head may include a locking feature to lock the strap to the housing. The present invention is disclosed in several configurations including a housing having an elongate body where the head may be attached to the body along one longitudinal side or at either end.

DETAILED DESCRIPTION OF THE PREFERRED EMBODIMENT

The present invention provides a hang tag for supporting an electronic article surveillance (EAS) marker therein for attachment to an article for which theft protection is desired to be provided. The articles which may be used in combination with the hang tag of the present invention may be any article for which theft protection is desired. Typically, such articles may include clothes, jewelry and other apparel accessories. In many cases, due to the size of the article, it is difficult to conceal the marker thereon. Thus, the potential purchaser would readily see the hang tag supporting the EAS marker. This could result in an unauthorized attempt to remove the hang tag from the article so as to defeat the electronic article surveillance system.

Figure 1:
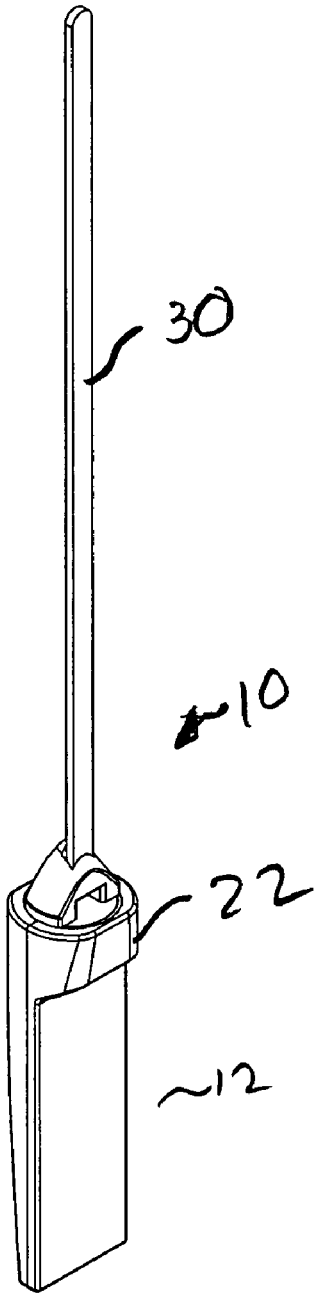
FIG. 1 is a front perspective showing of a first embodiment of the hang tag of the present invention.
Figure 2:
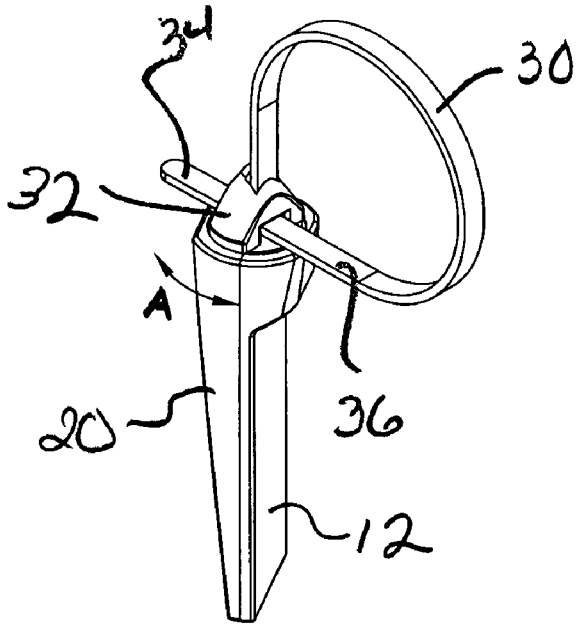
FIG. 2 is a perspective view of the hang tag of FIG. 1 in the inserted position.
Figure 3:
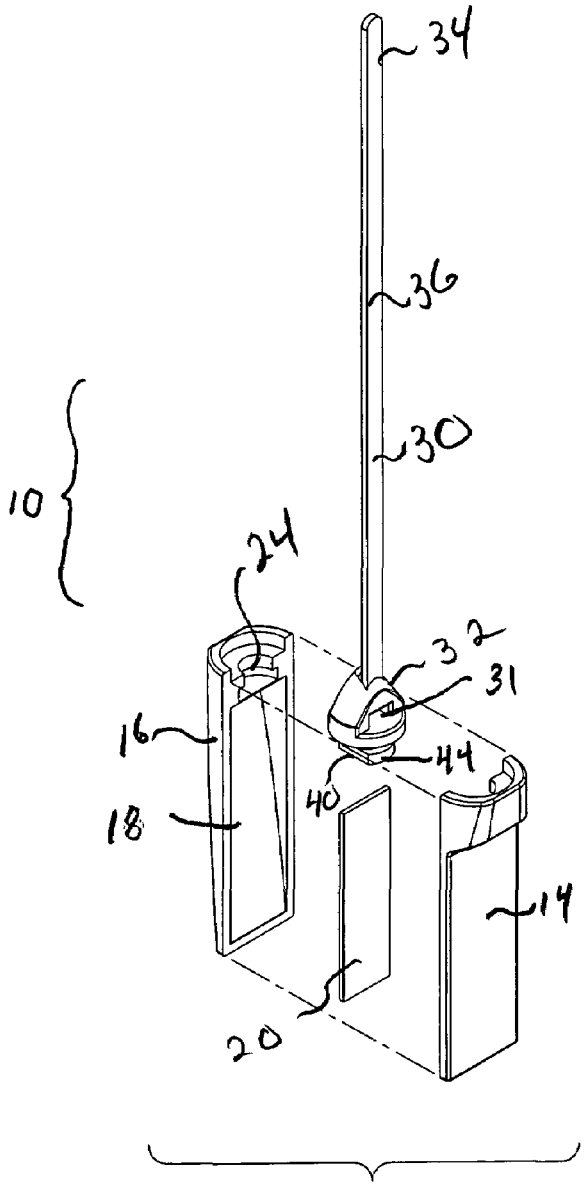
FIG. 3 is an exploded perspective view of the hang tag of FIG. 1 showing an EAS marker supported therein.

Referring to FIGS. 1–7, a hang tag of one embodiment of the present invention is shown. Hang tag 10 includes an elongate housing 12 which is formed of two components 14 and 16 as shown in FIG. 3. The components 14 and 16 forming housing 12 may be preferably made of a suitable plastic by molding or other techniques. The two components may be permanently secured together and define a marker cavity 18 therebetween for supporting an electronic article surveillance (EAS) marker 20. An upper portion 22 of the assembled housing 12 defines a head reception cavity 24 for accommodating therein, as will be described in further detail hereinbelow, a securement strap 30.

Figure 4:
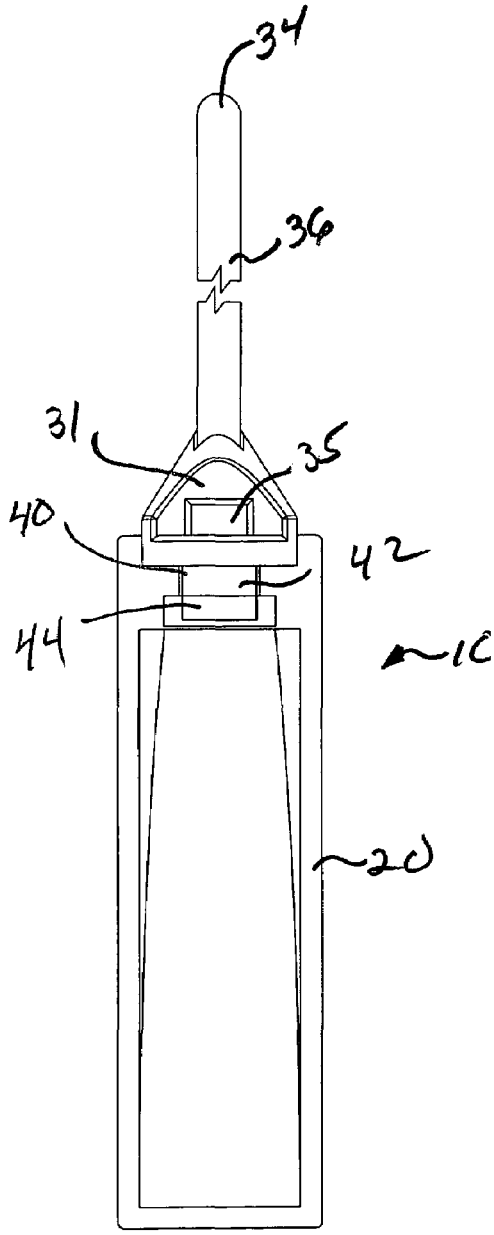
FIG. 4 is a front plan view of the hang tag of FIG. 1.

Securement strap 30 is similar to a conventional commercially available plastic cable tie having a head 32 at one end, a tail 34 at the other end and an elongate strap body 36 therebetween. In conventional fashion, as shown in FIG. 2, the tail 34 of the strap 30 may be inserted into an aperture 31 in head 32 to form a closed loop. It is contemplated that the strap is to be placed about the article to which it is to be secured and then the tail 34 is looped through the head. As shown in FIG. 4, the head 32 includes a locking device 35 supported therein. The locking device makes locking engagement with the body 36 of the strap to prevent withdrawal of the strap from the aperture 31 once the strap is secured therein. Thus, the strap becomes permanently secured about the article being removable only upon severing.

In order to prevent the easy and unauthorized removal of the strap from the article, for example, by twisting the strap until it breaks, the present invention provides for the swivel attachment of the strap 30 to housing 12.

Referring now FIG. 3, the head 32 of strap 30 includes a projection 40 extending oppositely of strap body 36. Projection 40 is generally T-shaped having a central stem 42 and a distal cross member 44. The upper end 22 of housing 20 is formed to have a receiving cavity 24 of like shape so as to accommodate therein projection 40. While captively retained within cavity 24, the cavity 24 and the projection 40 are configured so as to permit complete and continuous rotation of the strap 30 with respect to the body 20, such rotation being shown by arrow A in FIG. 2.

The housing 20 may be assembled as follows. The strap is placed in the upper end 22 of housing 20 so that projection 40 is positioned in one half of cavity 24. Thereafter, the EAS marker 20 is placed within one half of cavity 18. The two components 14, 16 of housing 20 can be assembled together to enclose EAS marker 20 and projection 40 within the housing. Various techniques to permanently secure the two components 14 and 16 of housing 20 together may be employed. Such techniques may include adhesives, snap closures, ultrasonic welding and the like.

Figure 5:
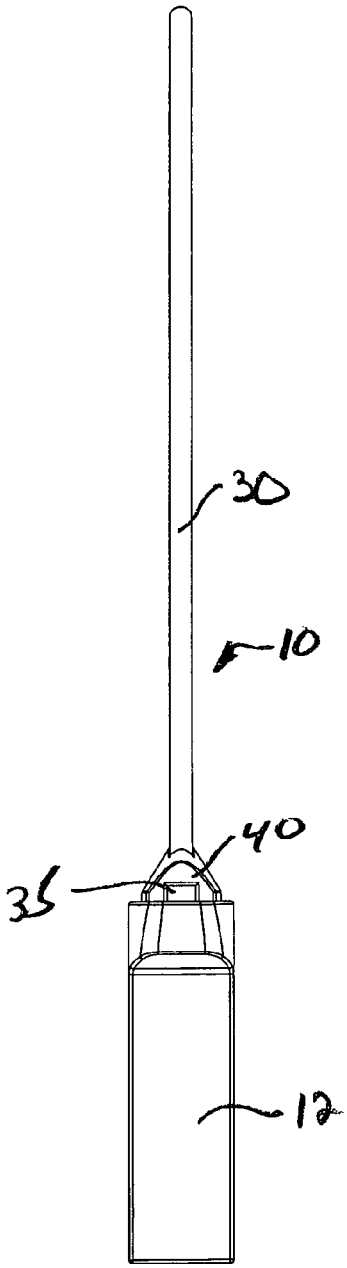
FIGS. 5–7 are front, side and rear elevational showings of the hang tag of FIG. 1.
Figure 6:
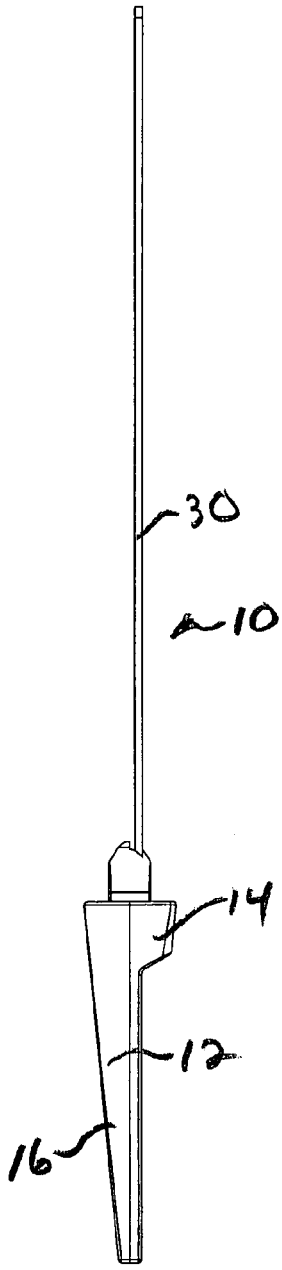
Figure 7:
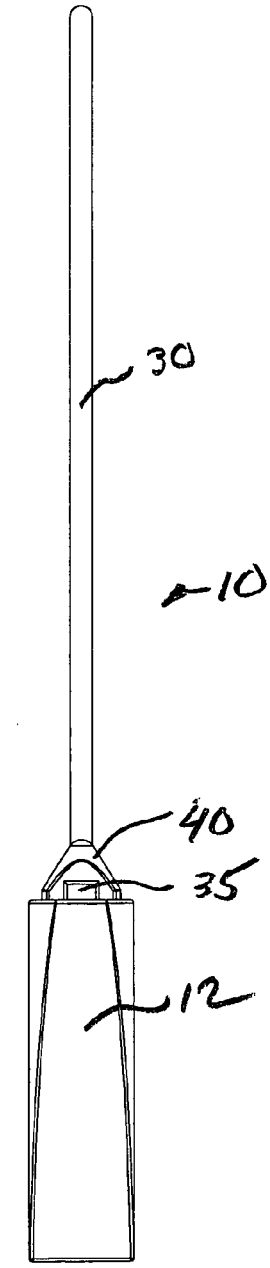

The assembled hang tag 10 shown in FIGS. 5–7 permits full rotation of strap 30 within housing 12 by virtue of the configuration of projection 40 within cavity 24. Thus, strap 30 is permanently but fully rotatably captive within housing 20.

Figure 8:
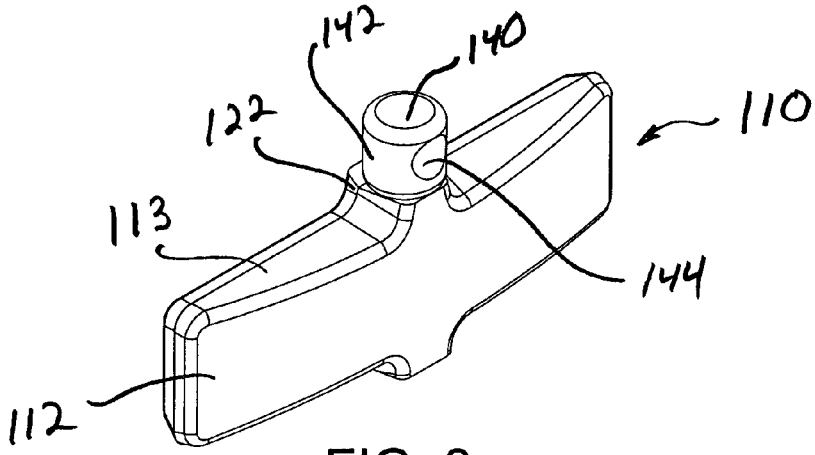
FIG. 8 is a perspective showing of a further embodiment of the hang tag of the present invention.
Figure 9:
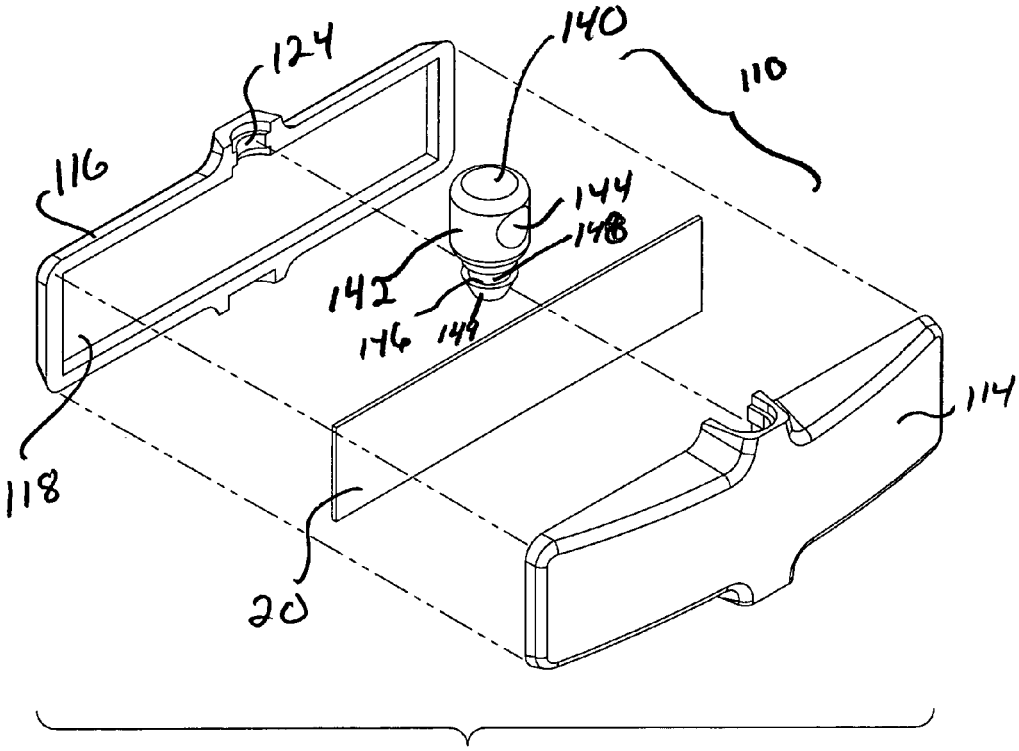
FIG. 9 is an exploded perspective view of the hang tag of FIG. 8.

Referring now to FIGS. 8 and 9, a further embodiment of the present invention is shown. Hang tag 110 includes an elongate housing 112 formed of two components 114 and 116 which define therebetween a cavity 118 for receipt of EAS marker 20. The housing 112 includes a head reception member 122 having a cavity 124 formed therein. In the present illustrative embodiment the head reception member 124 is formed along one longitudinal side 113 of housing 112.

Housing 112 captively retains, between its two components 114 and 116, a strap receiving head 140. Head 140 includes an upper cylindrical portion 142 having a continuous aperture 144 therethrough. The aperture 144 of head 140 is designed to insertably receive therein a conventional cable tie (not shown). The cable tie may be of similar configuration to the strap 30 shown in FIGS. 1–7 having a self-locking head for accommodating the strap. Thus, a conventional cable tie may be secured about the article to be protected and through the head 140 of tag 110 to secure the tag to the article.

The head 140 is rotatably captive within head receptacle member 122. In that regard, head 140 includes a depending projection 146 having a cylindrical central stem 148 and a larger cross member 149 at the end thereof. The projection 146 is designed for captive receipt within the cavity 124 of element 122.

As with the embodiment of FIGS. 1–7, the head 140 is positioned such that it is fully rotatable within head receptacle member 122 once the components 114 and 116 are assembled. The cavity 124 mirrors the shape of projection 146.

The tag 110 is assembled by inserting the EAS marker 20 within cavity 118 and the head 140 within element 122. The two components 114 and 116 are then permanently secured together such that the head is captive within element 122 but fully rotatably with respect thereto. A cable tie may be inserted through aperture 144 and through and around the article to be protected in a manner such that the strap of the cable tie is locked within the head of the cable tie as is well-known. This permanently secures hang tag 110 to the article yet allows the hang tag to be fully rotatable with respect to the head.

The present invention shows housings 12 and 112 to be elongate generally rectangular members so as to accommodate a rectangular EAS marker. However, other configurations may be employed depending upon the particular shape of the EAS marker. Moreover, the strap of the FIG. 1 embodiment of the present invention is shown secured to an end of elongate housing 12, whereas, the head 140 of tag 110 is shown secured along the longitudinal side thereof. Any combination of such configurations is well within the contemplation of the present invention.

Various changes to the foregoing described and shown structures will now be evident to those skilled in the art. Accordingly, the particularly disclosed scope of the invention is set forth in the following claims.

What is claimed is:

1. A hang tag comprising:

a housing for supporting an EAS marker therein;

a securement head for accommodating a securement strap for coupling to an article, said head being coupled to said housing for continuous rotation with respect thereto.

2. A hang tag of claim 1 wherein said head includes an aperture therethrough for receipt of said strap.

3. A hang tag of claim 2 wherein said head includes said securement strap integrally formed therewith.

4. A hang tag of claim 3 wherein said strap includes an elongated body extending at one end from said head and a tail at said other end, said tail being insertable into said aperture.

5. A hang tag of claim 4 wherein said strap may be lockingly engaged within said aperture of said head.

6. A hang tag of claim 1 wherein said housing is an elongate member having two opposed ends.

7. A hang tag of claim 6 wherein said head is coupled to one of said ends of said housing.

8. A hang tag at claim 6 wherein said head is coupled to said housing intermediate said ends.

9. A hang tag of claim 1 wherein said housing is a two-part member defining a marker cavity therebetween for accommodating said EAS marker.

10. A hang tag of claim 9 wherein said housing defines a head cavity for supporting said head.

11. A hang tag of claim 10 wherein said head is secured within said head cavity between said two-part member.

12. A hang tag assembly comprising:

a housing for supporting an EAS marker therein:

an elongate attachment strap extending from said housing for coupling said housing to an article;

said attachment strap having a head at one end, a tail at the other end and a strap body therebetween;

said tail being lockingly secured to said head upon coupling to said article;

said head being rotatably attached to said housing for permitting continuous rotation of said housing with respect to said strap.

13. A hang tag assembly of claim 12 wherein said two-piece member defines a marker cavity therebetween for support of said EAS marker.

14. A hang tag of claim 13 wherein said housing defines a head reception cavity for supporting said head of said attached strap.

15. A hang tag of claim 13 wherein said housing is formed from two components with said maker cavity and said head reception cavity being defined therebetween.

16. A hang tag of claim 12 wherein said head includes an aperture therethrough for insertion of said strap for said locking securement of said tail to said head.

* * * * *

UNITED STATES PATENT AND TRADEMARK OFFICE

CERTIFICATE OF CORRECTION

PATENT NO. : 7,183,914 B2
APPLICATION NO. : 11/067824
DATED : February 27, 2007
INVENTOR(S) : Norman et al.

It is certified that error appears in the above-identified patent and that said Letters Patent is hereby corrected as shown below:

On the front page of the patent, under the heading of (74) Attorney agent of Firm delete "Hoffman & Baron, LLP" and insert therefor --Hoffmann & Baron, LLP--.

At column 1, line 24, delete "the EAS mark, the purchaser" and insert therefor --the EAS marker, the purchaser--.

Signed and Sealed this

First Day of May, 2007

JON W. DUDAS
*Director of the United States Patent and Trademark Office*